US005945038A

United States Patent [19]

Anderson

[11] Patent Number: 5,945,038

[45] Date of Patent: Aug. 31, 1999

[54] HUMIDIFIER WICK ASSEMBLY WITH FLOAT ROD RETAINER

[75] Inventor: Barry G. Anderson, Sheboygan, Wis.

[73] Assignee: Bemis Manufacturing Company, Sheboygan Falls, Wis.

[21] Appl. No.: 09/130,794

[22] Filed: Aug. 7, 1998

[51] Int. Cl.[6] ..... B01F 3/04

[52] U.S. Cl. ..... 261/26; 261/96; 261/105; 261/107

[58] Field of Search ..... 261/26, 30, 64.5, 261/96, 102, 105, 104, 107, DIG. 41

[56] References Cited

U.S. PATENT DOCUMENTS

| | | | |
|---|---|---|---|
| 3,637,194 | 1/1972 | Swimmer et al. | 261/26 |
| 5,037,583 | 8/1991 | Hand | 261/107 |
| 5,108,663 | 4/1992 | Chiu | 261/26 |
| 5,114,625 | 5/1992 | Gibson | 261/96 |
| 5,143,656 | 9/1992 | Marino et al. | 261/26 |
| 5,397,510 | 3/1995 | Clark | 261/26 |

*Primary Examiner*—C. Scott Bushey
*Attorney, Agent, or Firm*—Michael Best & Friedrich LLP

[57] ABSTRACT

A wick assembly for use in a humidifier including a housing defining an air inlet, an air outlet, and a reservoir adapted to contain water, a fan for creating an air flow path between the inlet and the outlet, and a float assembly for stopping the operation of the fan when an insufficient amount of water is present within the reservoir, the float assembly including a float rod, the wick assembly having a lower portion locatable within the reservoir and an upper portion locatable within the air flow path so that the wick assembly conducts water from the reservoir to the air flow path, the wick assembly including a frame, an absorbent wick supported by the frame, and a retainer mounted on the frame for movement between an extended position wherein the retainer can support the float rod, and a retracted position facilitating packaging of the wick assembly.

33 Claims, 5 Drawing Sheets

58
86
10
66
70
62
74
80
114
78
54
82
110
182
142
170
46
118
122
26
134
14
38
18
138
102
50
22
42
106
34

HUMIDIFIER WICK ASSEMBLY WITH FLOAT ROD RETAINER

BACKGROUND OF THE INVENTION

The invention relates to humidifiers, and more particularly to evaporative home humidifiers.

One conventional type of home humidifier includes a housing or cabinet with a reservoir or tank of water and a stationary wick assembly in the cabinet. The lower end of the wick assembly is located in the water reservoir to absorb the water. Air blown through the wick element evaporates water from the wick element and transfers the water to the atmosphere. With a stationary wick, the level of water in the reservoir should remain relatively constant to provide for both continuous absorption of water by the wick and sufficient air flow through the wick. An example of this type of humidifier is disclosed in U.S. Pat. No. 5,110,511 issued May 5, 1992.

It is known to provide a float assembly in the water reservoir for deactivating the humidifier when the water level is deficient. A typical float assembly includes a float and a float rod extending upwardly from the float. The float rod is commonly supported by a stationary retainer mounted to the inside of the humidifier housing. When the water level is sufficient, the upper end of the float rod closes an activation switch and the humidifier operates. As the water level falls, the float and the float rod descend, guided by the retainer, until the float rod no longer closes the activation switch, at which point the humidifier is deactivated. An example of this type of float assembly is disclosed in U.S. Pat. No. 5,108,663, issued Apr. 28, 1992.

SUMMARY OF THE INVENTION

Mounting the float rod retainer to the housing of a humidifier creates various problems. One problem is the difficulty in manufacturing such a housing. Since most humidifier housings are made from molded plastic, manufacturing a housing with an integral retainer is not commonly done as it is both difficult and expensive.

Rather, the retainer is usually molded by itself and then attached to the housing using common fasteners. Typically, this assembly process includes drilling or otherwise forming at least one hole in the housing to accommodate the fastening of the retainer. While less difficult and less costly than integrally molding the retainer in the housing, this assembly procedure is still time-consuming and costly.

A related problem with mounting the retainer to the inside of the housing is the fact that forming a hole in the housing for accepting a fastener reduces the aesthetic quality of the humidifier. Consumers do not want to see holes and fasteners on the exterior of the humidifier.

To alleviate these problems, the present invention provides a humidifier having an improved method of retaining the float assembly. More particularly, the invention provides a humidifier having a float assembly slidably supported by a retainer that is mounted to the wick assembly, rather than to the housing. Mounting the retainer to the wick assembly alleviates manufacturing problems as the retainer and wick assembly can be both molded and assembled at the same molding press. Furthermore, the wick assembly and retainer can be molded to allow for fastener-free mounting, and no unsightly holes or fasteners are needed on the exterior of the humidifier, making it more aesthetically pleasing to the consumer.

Specifically, the invention provides a wick assembly that includes a frame, an absorbent wick supported by the frame, and a retainer mounted on the frame for movement between an extended position, wherein the retainer can support a float assembly, and a retracted position, which facilitates packaging of the wick assembly. This is especially important for the packaging of replacement wick assemblies sold separately from humidifiers.

The wick assembly frame preferably includes top and bottom horizontally extending members and left and right vertically extending members. The retainer is preferably mounted on the top member. In the preferred embodiment, the frame and retainer are made of injection molded plastic. The frame includes integrally molded guide members for slidably engaging the retainer. The frame also includes first and second recesses or apertures. The retainer includes a downward facing detent for engaging either of the two recesses. When the retainer is in the extended position, the detent extends into the first recess and removably secures the retainer in the extended position. When the retainer is in the retracted position, the detent extends into the second recess, removably securing the retainer in the retracted position.

In one embodiment of the invention, the detent includes ramp surfaces for facilitating the movement of the detent into or out of the recesses.

Other features and advantages of the invention will become apparent to those skilled in the art upon review of the following detailed description, claims and drawings.

Figure 1:
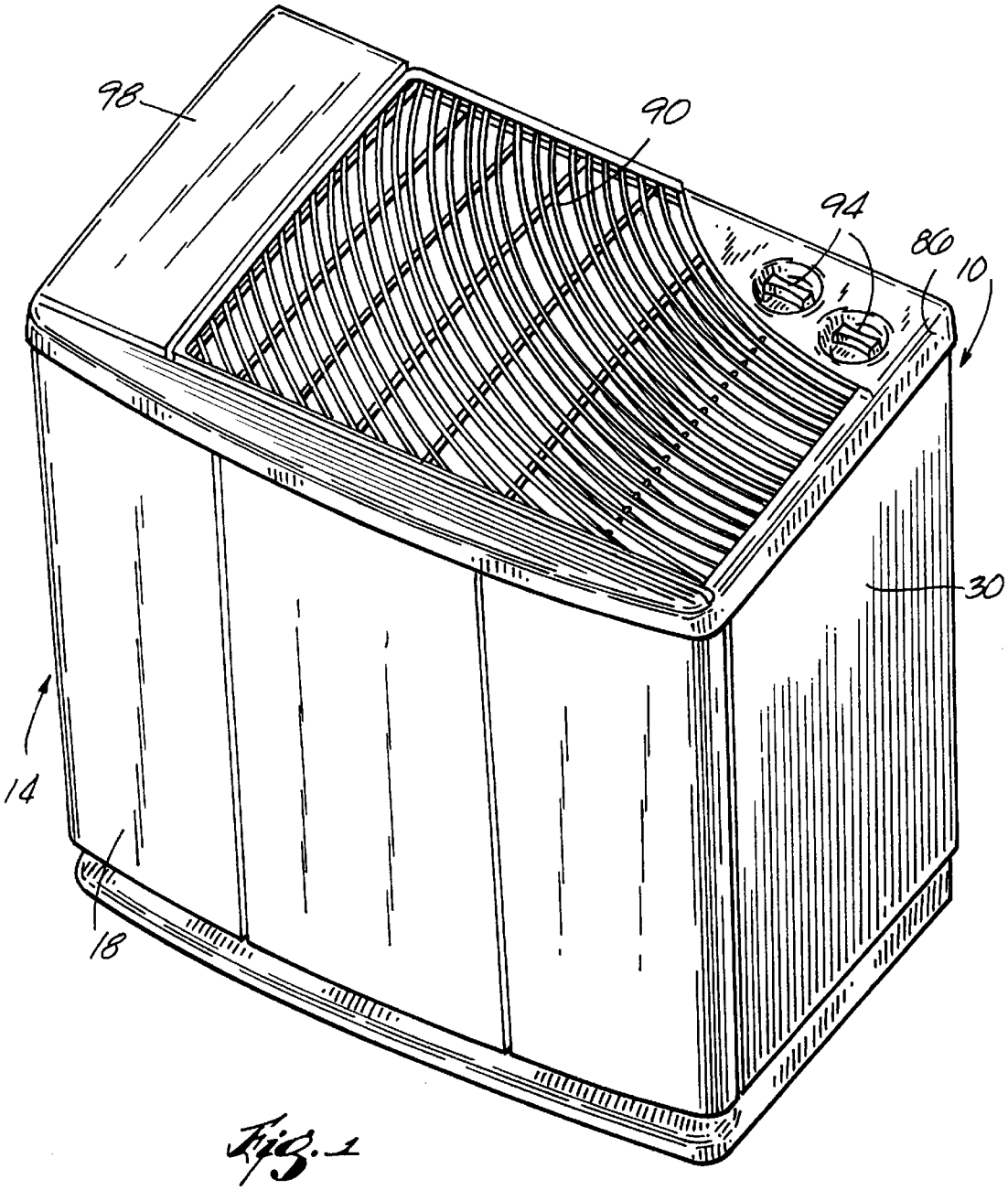
FIG. 1 is a top perspective view of a humidifier embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

A humidifier 10 embodying the invention is shown in FIGS. 1–8. The humidifier 10 comprises a housing or cabinet 14 (see FIGS. 1 and 2). The cabinet 14 is preferably unitary and injection-molded and includes opposite front and rear walls 18 and 22, opposite left and right side walls 26 and 30, and a bottom wall 34 extending between the side walls 26 and 30 and between the front and rear walls 18 and 22. The rear wall 22 has therein an air inlet 38. The walls of the cabinet 14 together form a reservoir or trough 42 adapted to contain water.

The humidifier 10 also comprises (see FIG. 2) a water bottle 46 removably located inside the cabinet 14 for supplying water to the reservoir 42. While there are various suitable methods for supplying water from the water bottle 46 to the reservoir 42, in the preferred embodiment a known cap/valve apparatus 50 is used. The cap/valve 50 maintains a substantially constant level of water in the reservoir.

Figure 2:
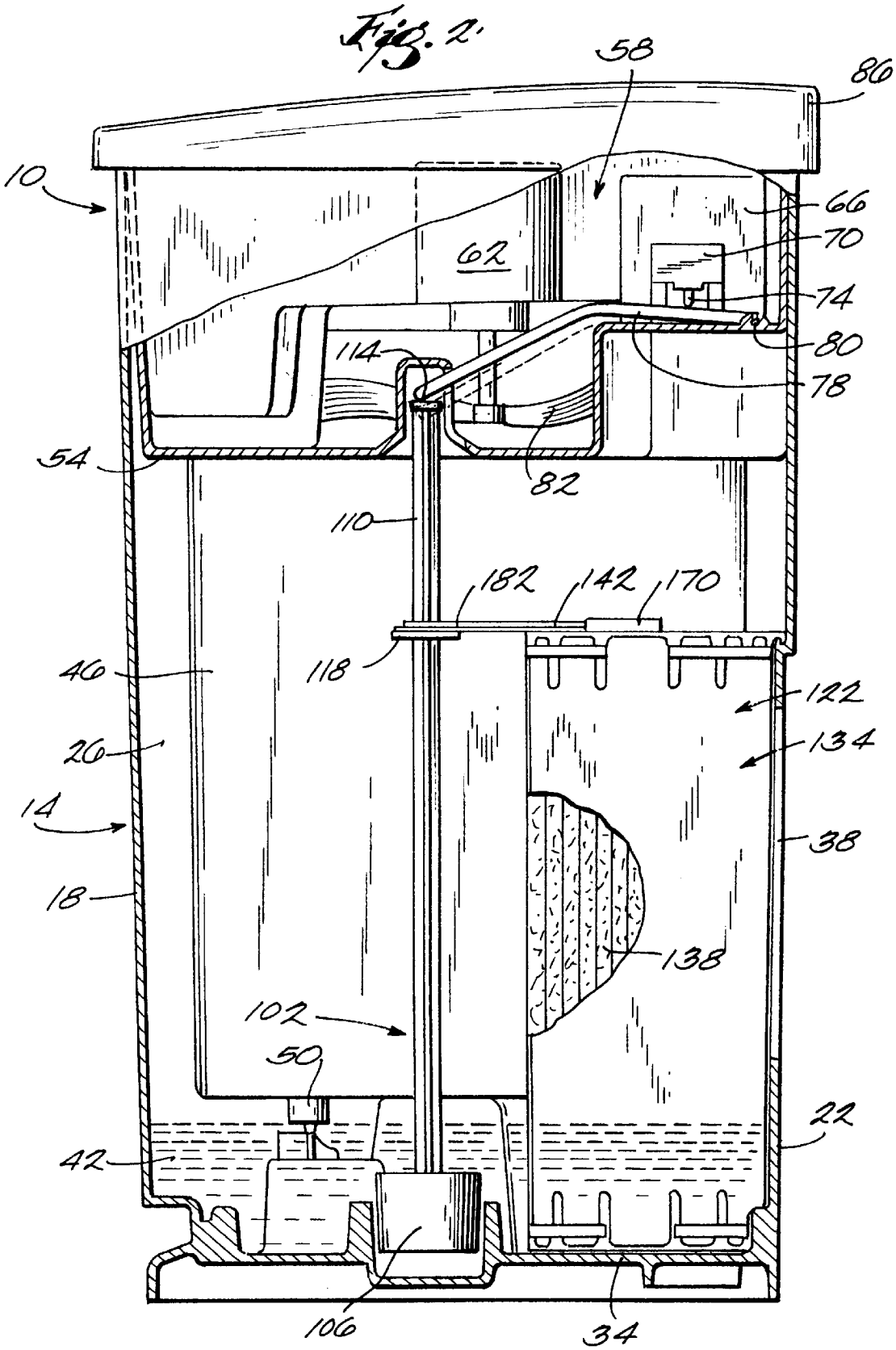
FIG. 2 is a side elevational view, partially in section, of the humidifier.

The humidifier 10 further comprises a motor chassis 54 that rests on top of and extends down into the cabinet 14 (see FIG. 2). The chassis 54 is preferably made from injection-molded plastic and supports a motor assembly 58. The motor assembly 58 includes a motor 62 and electrical controls 66 which include an activation switch 70 for allowing or preventing the supply of power to the motor 62. The activation switch 70 includes a push-button 74 that creates an electrical contact when depressed and breaks the contact when not depressed. Consequently, the motor 62 is on when the button 74 is depressed and is off when the button 74 is not depressed. An activating arm 78 is mounted to the chassis 54 for pivotal movement about an axis 80 such that the arm 78 can be pivoted upward to depress the push-button 74. The operation of the activating arm 78 will be described in further detail below.

The motor assembly 58 also includes a fan 82 that is driven by the motor 62. When the activation switch 70 is closed, the motor 62 operates to drive the fan 82. When the activation switch 70 is open, the motor 62 does not drive the fan 82.

The humidifier 10 also comprises (see FIG. 1) a grille cover 86 including an air outlet grille 90 and humidifier control knobs or dials 94 connected to the electrical controls 66. The grille cover 86 covers a portion of the cabinet 14 and substantially all of the chassis 54. The remainder of the cabinet 14 left uncovered by the grille cover 86 is the portion that houses the water bottle 46. This portion of the cabinet 14 is covered by a water bottle cover 98, also made from injection-molded plastic. The water bottle cover 98 allows easy access to the water bottle 46 for filling and refilling, without the need to remove the grille cover 86 and the chassis 54 at the risk of damaging the electrical components.

The humidifier 10 also comprises (see FIG. 2) a float assembly 102 for stopping the operation of the motor 62 when an insufficient amount of water is in the reservoir 42. The float assembly 102 includes a buoyant float 106 and a float rod 110 extending upwardly from the float 106 (see FIGS. 2 and 3). The float 106 and float rod 110 may either be integral or two separate members secured together. Regardless of the construction, at least the float 106 is made of any buoyant material such as foam, rubber, or plastic.

The float rod 110 includes an upper end 114 for contacting the activating arm 78. The float rod 110 also includes a limiting member 118, the function of which will be described below. The limiting member 118 is fixed against axial movement relative to the rod 110 and can be integral with the float rod 110 or may be an attachment. In the illustrated embodiment, the. limiting member 118 is an integrally formed plastic disc extending radially from the float rod 110. The float rod 110 is supported in a manner described in detail below.

Figure 3:
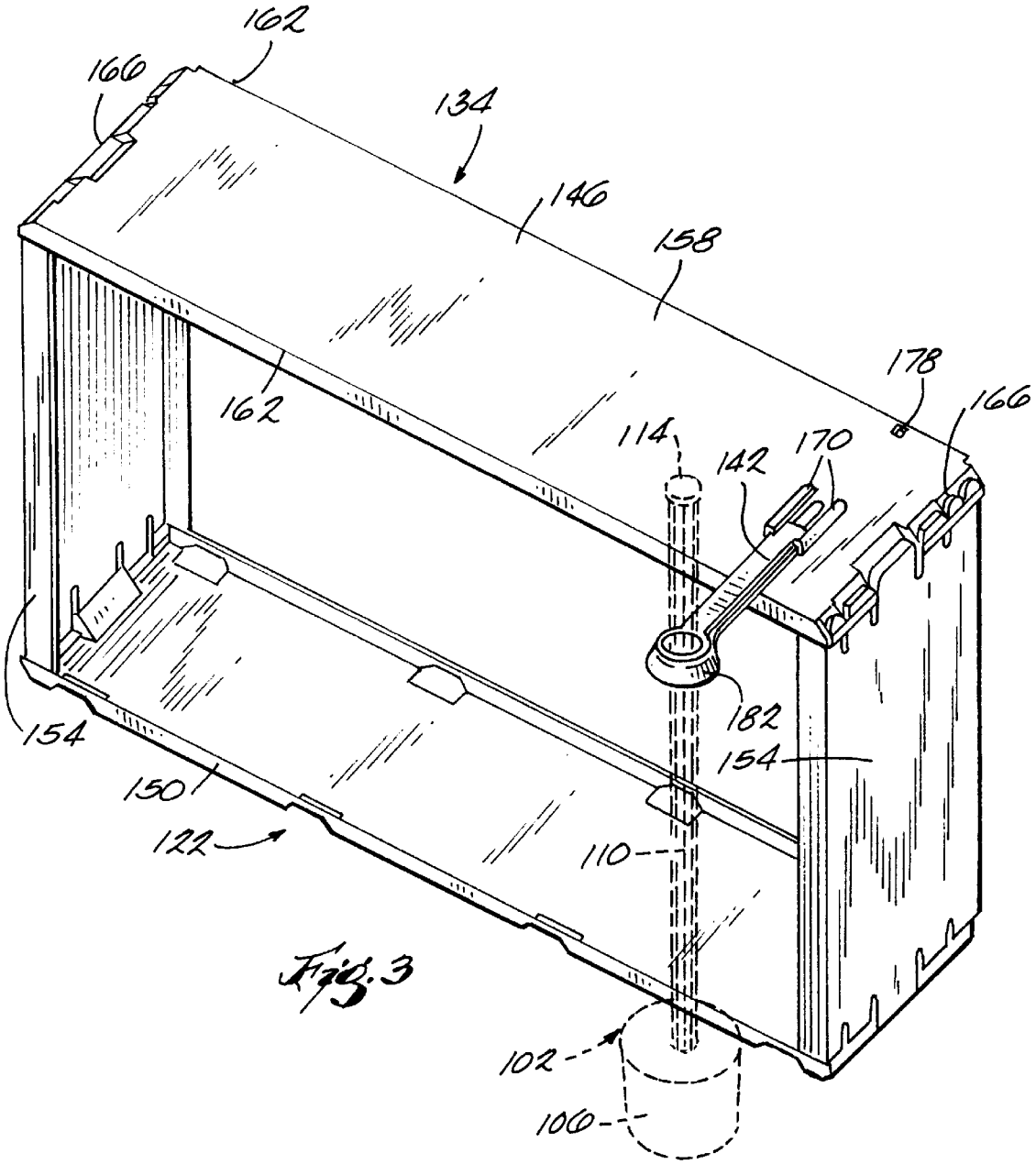
FIG. 3 is a front perspective view of the frame and retainer of the wick assembly.

The humidifier 10 also comprises a removable wick assembly 122 (see FIGS. 2 and 3). The wick assembly 122 includes a lower portion located within the reservoir 42 and an upper portion located in front of the air inlet 38. The wick assembly 122 includes a frame 134, an absorbent wick 138 (see FIG. 2) supported by the frame 134, and a retainer 142 mounted on the frame 134. The frame 134 is generally rectangular having (see FIG. 3) a generally horizontal top portion 146, a generally horizontal bottom portion 150, and two generally vertical side portions 154. The frame 134 is preferably made from injection-molded plastic. The top portion 146 includes a generally horizontal top surface 158 with two elongated sides 162 and two short sides 166.

The top surface 158 includes guide members 170. Preferably, the guide members 170 are integrally formed with the top portion 146 during the injection-molding process, however, the guide members 170 may also be separate members that attach to the top surface 158. In the illustrated embodiment, the guide members 170 have a substantially L-shaped cross-section (see FIG. 6) for engaging the retainer 142, but could have other configurations suitable for providing sliding engagement.

Figure 4:
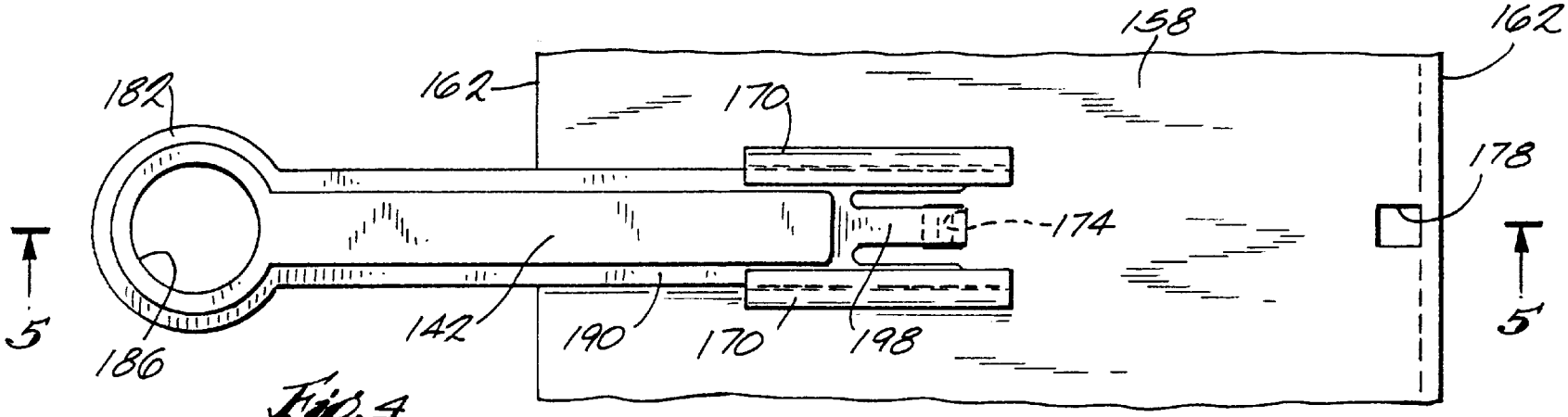
FIG. 4 is a partial top view of the frame showing the retainer in the extended position.
Figure 8:
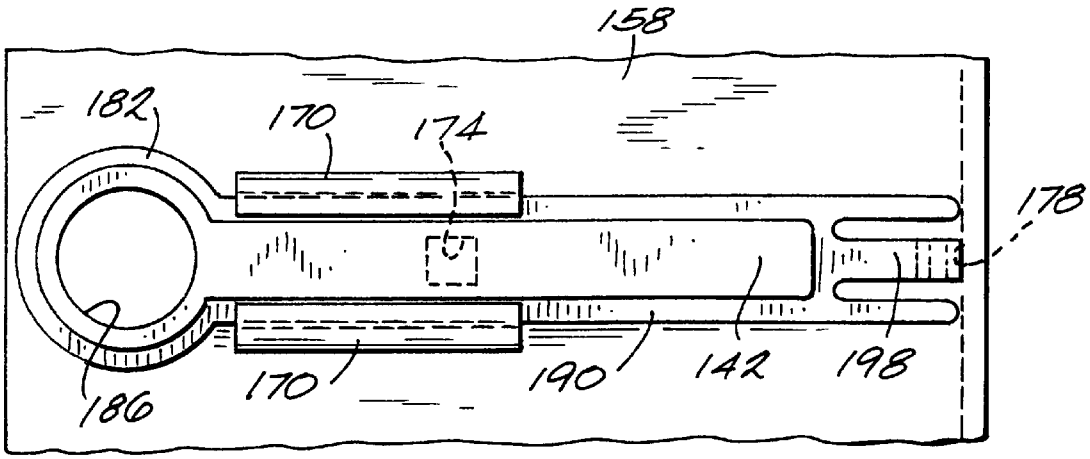
FIG. 8 is a partial top view of the frame showing the retainer in the retracted position.
Figure 5:
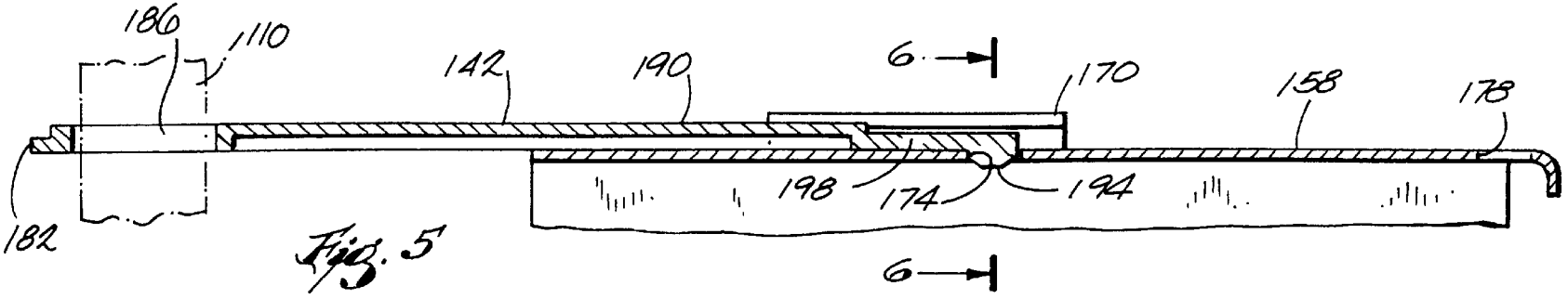
FIG. 5 is a view taken along line 5—5 in FIG. 4.
Figure 7:
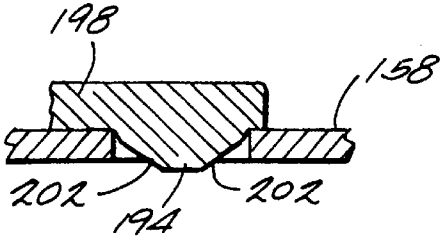
FIG. 7 is an enlarged portion of FIG. 5.
Figure 6:
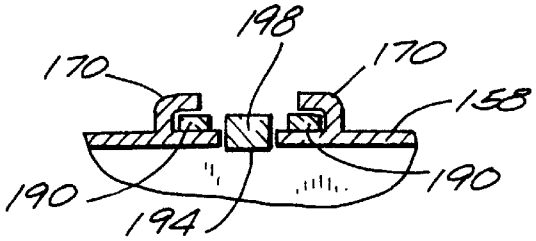
FIG. 6 is a view taken along line 6—6 in FIG. 5.

The top surface 158 also includes first and second recesses 174 and 178 (see FIGS. 4 and 5). The recess 174 is located substantially between the guide members 170 while the recess 178 is located in spaced relation to the recess 174. In the illustrated embodiment, the recesses 174 and 178 are apertures, however, the recesses 174 and 178 need not be apertures. The function of the recesses 174 and 178 will be described in detail below.

The retainer 142 is preferably made from injection-molded plastic and includes (see FIGS. 4 and 8) a retaining end 182 having therein an opening 186 for slidably supporting the float rod 110. The opening 186 is large enough to allow the float rod 110 to slidably extend therethrough, however, the opening 186 is not large enough to allow the limiting member 118 to pass through (see FIG. 2).

The retainer 142 further includes a body portion 190 adapted for slidable engagement with the guide members 170. While engaged, the retainer 142 is constrained to linear movement along the top surface 158 between an extended position (see FIG. 4), wherein the retainer 142 is cantilevered outward from the top surface 158, and a retracted position (see FIG. 8), wherein the retainer 142 is within the confines of the top surface 158. In the extended position, the retaining end 182 is positioned to accept and support the float rod 110 which slidably extends through the opening 186. In the retracted position, the retaining end 182 is positioned within the confines of the top surface 158 to facilitate packaging of the wick assembly 122. This is important as replacement wick assemblies 122, including retainers 142, are sold separately from the humidifier 10 for years of continued use. In the illustrated embodiment, the direction of linear movement of the retainer 142 is perpendicular to the elongated sides 162 of the top surface 158, however, this need not be the case. Furthermore, the retainer 142 could move relative to the wick assembly 122 in other ways (e.g. pivotal movement) and could be mounted on other surfaces of the wick assembly 122.

The body portion 190 of the retainer 142 includes a downward facing detent 194 (see FIGS. 5–7) located on a resilient finger 198. The detent 194 is adapted to engage the recess 174 or the recess 178 to removably secure the retainer 142 in either the extended position or the retracted position. For example, when the retainer is in the retracted position, the detent 194 engages the recess 178 to removably secure the retainer 142 in the retracted position. To move the retainer 142 to the extended position, the operator lifts slightly upward on the resilient finger 198 as he or she slides the retainer toward the extended position. This disengages the detent 194 from the recess 178. Sliding continues until the detent 194 engages the recess 174, removably securing the retainer in the extended position. In the illustrated embodiment, the detent 194 includes (see FIG. 7) ramp surfaces 202 for facilitating movement of the detent into and out of the recesses 174 and 178. In an alternative embodiment, it is not necessary to lift up on the finger 198 to move the retainer 142.

In operation, the retainer 142 is positioned in the extended position. The float assembly 102 is positioned within the reservoir 42 such that the float 106 is free to rise or fall with the level of water in the reservoir 42. The float 106 is preferably constrained within the reservoir 42 for movement in only a substantially vertical direction. The float rod 110 is extended through the opening 186 of the retainer 142 for slidable support. The filled water bottle 46 is inserted into the cabinet 14 to fill the reservoir 42 with water, and the water bottle cover 98 is replaced on the cabinet 14. As the reservoir 42 fills, the float assembly 102 moves upward with the water level causing the float rod 110 to slide upward in the opening 186 until stopped by the limiting member 118 which will not pass through the opening 186. The limiting member 118 functions to define the highest vertical limit of the upper end 114 of the rod 110.

When the water level is sufficient, the upper end 114 of the rod 110 contacts the activating arm 78 causing it to depress the push-button 74 such that the activation switch 70 is closed, providing power supply to the motor 62. The motor drives the fan 82 which draws air into the air intake 38 and blows it out of the air outlet grille 90, creating an air flow path through the cabinet 14. The upper portion of the wick assembly 122 is in this air flow path. The air flow passes through the wick 138, which has absorbed water from the reservoir 42 and conducted the water to the upper portion of the wick, so that the moisture from the upper portion evaporates and is transferred to the air which then exits the air outlet grille 90.

As the water level falls due to a lack of sufficient water in the reservoir, the float 106 and the float rod 110 descend, guided by the retainer 142, until the upper end 114 of the rod 110 is no longer high enough to cause the activating arm 78 to depress the push-button 74 to close the activation switch 70. The power supply to the motor 62 is then cut and the humidifier 10 is deactivated until the reservoir is refilled.

Various features of the invention are set forth in the following claims.

I claim:

1. A humidifier comprising:

a housing defining an air inlet, an air outlet, and a reservoir adapted to contain water;

a motor assembly supported by said housing, said motor assembly including a motor, an activation switch having on and off positions corresponding to on and off states of said motor, and a fan driven by said motor for creating an air flow path between said inlet and said outlet;

a wick assembly supported within said housing, said wick assembly having a lower portion within said reservoir and an upper portion within said air flow path so that said wick assembly conducts water from said reservoir to said air flow path, said wick assembly including a frame, an absorbent wick supported by said frame, and a retainer mounted on said frame; and a float assembly for stopping the operation of said motor when an insufficient amount of water is present within said reservoir, said float assembly including a buoyant float in said reservoir, and a rod extending upwardly from said float, said rod being slidably supported by said retainer, and said rod having an upper end for engaging said activation switch such that said switch is in said on position when said float is elevated by sufficient water in said reservoir, and is in said off position when sufficient water in said reservoir is lacking.

2. The humidifier as claimed in claim 1, wherein said retainer is movable relative to said frame between an extended position and a retracted position.

3. The humidifier as claimed in claim 2, wherein said retainer is cantilevered outward from said frame when said retainer is in said extended position.

4. The humidifier as claimed in claim 3, wherein said retainer is within the confines of said frame when said retainer is in said retracted position so as to facilitate packaging of said wick assembly.

5. The humidifier as claimed in claim 4, wherein said frame has a top surface, and wherein said retainer is mounted on said top surface.

6. The humidifier as claimed in claim 5, wherein said top surface has thereon guide members, and wherein said retainer slidably engages said guide members such that said retainer is constrained to linear movement along said top surface.

7. The humidifier as claimed in claim 6, wherein said top surface includes two elongated sides and two short sides, and wherein said linear movement of said retainer is in a direction perpendicular to said elongated sides.

8. The humidifier as claimed in claim 6, wherein said retainer includes a retaining end having therein an opening, and a body portion extending from said retaining end for engaging said guide members, and wherein said rod slidably extends through said opening.

9. The humidifier as claimed in claim 8, wherein said top surface has therein first and second recesses, and wherein said body portion has thereon a downward facing detent, wherein said detent extends into said first recess when said retainer is in said extended position so that said retainer is removably secured in said extended position, and wherein said detent extends into said second recess when said retainer is in said retracted position so that said retainer is removably secured in said retracted position.

10. The humidifier as claimed in claim 9, wherein said top surface and said guide members are integrally formed using injection molding.

11. The humidifier as claimed in claim 10, wherein said guide members have a substantially L-shaped cross section.

12. The humidifier as claimed in claim 9, wherein said recesses are apertures.

13. The humidifier as claimed in claim 9, wherein said detent includes ramp surfaces for facilitating movement of said detent into and out of said recesses.

14. The humidifier as claimed in claim 1, wherein said rod and said float are separate members secured together.

15. The humidifier as claimed in claim 1, wherein said wick assembly includes a generally rectangular frame having a top portion, a generally horizontal bottom portion and two generally vertical side portions, and wherein said retainer is mounted on said top portion.

16. A wick assembly for use in a humidifier including a housing defining an air inlet, an air outlet, and a reservoir adapted to contain water, a fan for creating an air flow path between the inlet and the outlet, and a float assembly for stopping the operation of the fan when an insufficient amount of water is present within the reservoir, the float assembly including a float rod, said wick assembly having a lower portion locatable within the reservoir and an upper portion locatable within the air flow path so that the wick assembly conducts water from the reservoir to the air flow path, said wick assembly comprising a frame, an absorbent wick supported by said frame, and a retainer mounted on said frame for movement between an extended position wherein said retainer can support the float rod, and a retracted position facilitating packaging of said wick assembly.

17. The wick assembly as claimed in claim 16, wherein said retainer is cantilevered outward from said frame when said retainer is in said extended position.

18. The wick assembly as claimed in claim 17, wherein said retainer is within the confines of said frame when said retainer is in said retracted position.

19. The wick assembly as claimed in claim 18, wherein said frame has a top surface, and wherein said retainer is mounted on said top surface.

20. The wick assembly as claimed in claim 19, wherein said top surface has thereon guide members, and wherein, said retainer slidably engages said guide members such that said retainer is constrained to linear movement along said top surface.

21. The wick assembly as claimed in claim 20, wherein said retainer includes a retaining end having therein an opening through which the rod slidably extends, and a body portion extending from said retaining end for engaging said guide members.

22. The wick assembly as claimed in claim 21, wherein said top surface has therein first and second recesses, wherein said body portion has thereon a downward facing detent, wherein said detent extends into said first recess when said retainer is in said extended position so that said retainer is removably secured in said extended position, and wherein said detent extends into said second recess when said retainer is in said retracted position so that said retainer is removably secured in said retracted position.

23. The wick assembly as claimed in claim 22, wherein said top surface and said guide members are integrally formed using injection molding.

24. The wick assembly as claimed in claim 23, wherein said guide members have a substantially L-shaped cross section.

25. The wick assembly as claimed in claim 24, wherein said top surface includes two elongated sides and two short sides, and wherein said linear movement of said retainer is in a direction perpendicular to said elongated sides.

26. The wick assembly as claimed in claim 22, wherein said recesses are apertures.

27. The wick assembly as claimed in claim 22, wherein said detent includes ramp surfaces for facilitating movement of said detent into and out of said recesses.

28. A humidifier comprising:

a cabinet defining an air inlet, an air outlet, and a reservoir adapted to contain water;

a motor assembly removably mounted in said cabinet, said motor assembly including a motor above said reservoir, an activation switch having on and off positions corresponding to on and off states of said motor, and a fan driven by said motor for creating an air flow path between said inlet and said outlet;

a wick assembly removably supported within said cabinet, said wick assembly having a lower portion within said reservoir and an upper portion within said air flow path so that said wick assembly conducts water from said reservoir to said air flow path, said wick assembly including a generally rectangular frame having a top portion, said top portion including a generally horizontal top surface having thereon spaced guide members and spaced first and second recesses, and said frame also including a generally horizontal bottom portion and two generally vertical side portions;

an absorbent wick supported by said frame; and a retainer slidably mounted on said top surface, said retainer slidably engaging said guide members such that said retainer is constrained to linear movement along said top surface, said retainer including a retaining end having therein an opening, a body portion extending from said retaining end for engaging said guide members, and a downward facing detent on said body portion, said retainer being movable to an extended position wherein said retaining end and said body portion cantilever outwardly from said top surface, and wherein said detent extends into said first recess so that said retainer is removably secured in said extended position, to a retracted position wherein said retaining end and said body portion do not cantilever outwardly from said top surface, and wherein said detent extends into said second recess so that said retainer is removably secured in said retracted position; and a float assembly for stopping the operation of said motor when an insufficient amount of water is present within said reservoir, said float assembly including a buoyant float in said reservoir; and a rod extending upwardly from said float, said rod extending through said opening and being slidably supported by said retainer when said retainer is in said extended position, and said rod having an upper end for engaging said activation switch such that said switch is in said on position when said float is elevated by sufficient water in said reservoir, and is in said off position when sufficient water in said reservoir is lacking.

29. The humidifier as claimed in claim 28, wherein said top surface and said guide members are integrally formed using injection molding.

30. The humidifier as claimed in claim 28, wherein said guide members have a substantially L-shaped cross section.

31. The humidifier as claimed in claim 28, wherein said top portion includes two elongated sides and two short sides, and wherein said linear movement of said retainer is in a direction perpendicular to said elongated sides.

32. The humidifier as claimed in claim 28, wherein said recesses are apertures.

33. The humidifier as claimed in claim 28, wherein said detent includes ramp surfaces for facilitating movement of said detent into and out of said recesses.

* * * * *